US010576773B2

(12) United States Patent
Kecht et al.

(10) Patent No.: US 10,576,773 B2
(45) Date of Patent: Mar. 3, 2020

(54) SECURITY ELEMENT, METHOD FOR PRODUCING THE SAME AND VALUE DOCUMENT

(71) Applicant: GIESECKE+DEVRIENT CURRENCY TECHNOLOGY GMBH, München (DE)

(72) Inventors: Johann Kecht, München (DE); Axel Schlossbauer, München (DE); Stephan Steinlein, München (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 16/326,992

(22) PCT Filed: Aug. 22, 2017

(86) PCT No.: PCT/EP2017/001003
§ 371 (c)(1),
(2) Date: Feb. 21, 2019

(87) PCT Pub. No.: WO2018/036652
PCT Pub. Date: Mar. 1, 2018

(65) Prior Publication Data

US 2019/0168530 A1 Jun. 6, 2019

(30) Foreign Application Priority Data

Aug. 23, 2016 (DE) ..... 10 2016 010 196

(51) Int. Cl.
*B42D 25/36* (2014.01)
*B42D 15/00* (2006.01)
(Continued)

(52) U.S. Cl.
CPC ..... *B42D 25/36* (2014.10); *B42D 15/00* (2013.01); *B42D 25/369* (2014.10);
(Continued)

(58) Field of Classification Search
CPC ..... B42D 25/36; B42D 15/00
(Continued)

(56) References Cited

U.S. PATENT DOCUMENTS

2012/0080878 A1* 4/2012 Kecht ..... B41M 3/14 283/85
2013/0214523 A1* 8/2013 Kecht ..... C09K 11/7701 283/67
2019/0168530 A1* 6/2019 Kecht ..... B42D 25/45

FOREIGN PATENT DOCUMENTS

CA 2768601 A1 3/2011
EP 2169650 A1 3/2010
WO 2011029543 A2 3/2011

OTHER PUBLICATIONS

International Search Report and Written Opinion from PCT Application No. PCT/EP2017/001003, dated Oct. 18, 2017.

* cited by examiner

*Primary Examiner* — Betelhem Shewareged
(74) *Attorney, Agent, or Firm* — Workman Nydegger

(57) ABSTRACT

A security element for securing value documents comprises a first polymer containing a feature substance, which is at least partially surrounded by a second polymer, wherein the first polymer is a hydrophobic, water-insoluble polymer which, at an elevated pH value and at elevated ambient temperature at a treatment duration of less than 60 minutes can be converted into a hydrophilic, water-soluble polymer. The security elements also contains a second polymer, which is a hydrophilic, water-soluble polymer, wherein the
(Continued)

elevated pH value is greater than 12 and the elevated ambient temperature is greater than 90° C.

19 Claims, 1 Drawing Sheet

(51) Int. Cl.

| | |
|---|---|
| ***B42D 25/369*** | (2014.01) |
| ***B42D 25/382*** | (2014.01) |
| ***B42D 25/387*** | (2014.01) |
| ***B42D 25/45*** | (2014.01) |
| ***B42D 25/475*** | (2014.01) |
| *B42D 25/455* | (2014.01) |
| *B42D 25/46* | (2014.01) |

(52) U.S. Cl.
CPC ..... *B42D 25/382* (2014.10); *B42D 25/387* (2014.10); *B42D 25/45* (2014.10); *B42D 25/475* (2014.10); *B42D 25/455* (2014.10); *B42D 25/46* (2014.10)

(58) Field of Classification Search
USPC ..... 428/195.1
See application file for complete search history.

SECURITY ELEMENT, METHOD FOR PRODUCING THE SAME AND VALUE DOCUMENT

BACKGROUND

The invention relates to a security element for securing value documents, comprising a first polymer containing a feature substance, which is at least partially surrounded by a second polymer, wherein the first polymer is a hydrophobic, water-insoluble polymer which, at an elevated pH value and at an elevated ambient temperature at a treatment duration of at least 30 minutes, can be converted into a hydrophilic, water-soluble polymer, and the second polymer is a hydrophilic, water-soluble polymer. The invention further relates to methods for producing the security element and to a value document having the security element.

Paper recycling processes to which, for ecological reasons, ideally also value documents, in particular banknotes, which are worn or which have production defects, are to be subjected, usually take place at elevated temperature and at an elevated pH value. Conventional security elements for securing value documents, for example mottling fibers or planchets with feature properties such as, for example, UV luminescence, IR absorption or photochromism, however, are so stable that they are not destroyed under the conditions of the paper recycling processes. Typically, the conventional security elements are only damaged and thus remain in the paper stock as visible, disturbing fragments. Consequently, worn value documents, but also security paper containing security elements as starting material for producing banknotes that does not meet the specification for further processing, for example as a result of production errors (e.g. incorrect paper thickness, tears in the paper web, incorrect concentration of security elements), cannot readily be subjected to a conventional paper recycling process for security reasons. The paper producer thus incurs high costs for disposal.

It is the object of the invention to make available an improved security feature for securing value documents. It is desirable in particular to make available a security element that has a sufficient stability to water and moisture, so that the security element is not destroyed under the conditions of the paper production, but that is at the same time so unstable that the security element is destroyed under the more drastic conditions of the paper recycling process. The invention further relates to making available production methods for such a security element and to making available a value document equipped with the security element.

These objects are achieved by the combinations of features defined in the independent claims. Preferred embodiments are the subject matter of the subclaims.

SUMMARY OF THE INVENTION 1. (First aspect of the invention) A security element for securing value documents, comprising a first polymer containing a feature substance, which is at least partially surrounded by a second polymer, wherein the first polymer is a hydrophobic, water-insoluble polymer which, at an elevated pH value and at elevated ambient temperature at a treatment duration of less than 60 minutes, preferably less than 30 minutes, can be converted into a hydrophilic, water-soluble polymer, and the second polymer is a hydrophilic, water-soluble polymer, wherein the elevated pH value is greater than 12, preferably greater than 10, and the elevated ambient temperature is greater than 90° C., preferably greater than 60° C.

2. (Preferred embodiment) The security element according to paragraph 1, wherein the security element, when introduced into a moist paper stock, results in a mottling fiber or planchet. During the introduction, the water-soluble second polymer is partially dissolved and the structure of the first polymer is visible as a planchet or mottling fiber.

3. (Preferred embodiment) The security element according to paragraph 1 or 2, wherein the feature substance has luminescent, magnetic or photochromic properties and is preferably an IR absorber or a UV-excitable luminescent substance.

4. (Preferred embodiment) The security element according to any of paragraphs 1 to 3, wherein the first polymer can be converted into a water-soluble polymer by saponification in a basic medium.

5. (Preferred embodiment) The security element according to paragraph 4, wherein the first polymer is polyvinyl acetate or polyester and is preferably polyvinyl acetate.

6. (Preferred embodiment) The security element according to any of paragraphs 1 to 5, wherein the second polymer is polyvinyl alcohol or a polyvinyl alcohol copolymer, in particular a polyvinyl-pyrrolidone polyvinyl-alcohol copolymer or a polyvinyl-alcohol polyethylene-glycol graft copolymer, and is preferably polyvinyl alcohol.

7. (Preferred embodiment) The security element according to any of paragraphs 1 to 6, wherein the feature substance is a core-shell particle, wherein the core and the shell are preferably based on two different polymers, the shell can further preferably be attacked by the action of aqueous bases, and the shell is particularly preferably based on a melamine-formaldehyde condensation polymer.

8. (Preferred embodiment) The security element according to any of paragraphs 1 to 7, wherein the proportion of the first, hydrophobic, water-insoluble polymer in the security element amounts to less than 10 wt.-%.

9. (Preferred embodiment) The security element according to any of paragraphs 1 to 8, wherein the weight ratio of the feature substance in relation to the first, hydrophobic, water-insoluble polymer amounts to at least 1:1, preferably at least 9:1.

10. (Preferred embodiment) The security element according to any of paragraphs 1 to 9, wherein the first, hydrophobic, water-insoluble polymer has a molecular weight in a range of 100,000 g/mol to 500,000 g/mol.

11. (Preferred embodiment) The security element according to any of paragraphs 1 to 10, wherein the security element is obtainable by a method comprising the step of introducing a feature substance into a first polymer by means of extrusion; and the step of enveloping the first polymer thus obtained with a second polymer.

12. (Preferred embodiment) The security element according to any of paragraphs 1 to 10, wherein the security element is obtainable by a method comprising the step of making available a layer, in particular a foil, based on a second polymer;

the step of applying a solution containing a feature substance and a first polymer onto the layer based on a second polymer; and the step of placing a further layer, in particular a foil, based on a second polymer onto the layer based on a second polymer that is equipped with the solution of the feature substance and the first polymer.

13. (Preferred embodiment) The security element according to paragraph 12, wherein the layers each have foils having a thickness in the range of 10 to 100 micrometers, preferably 15 to 60 micrometers.

14. (Second aspect of the invention) A method for producing a security element for securing value documents according to any of paragraphs 1 to 10, comprising the step of introducing a feature substance into a first polymer by means of extrusion; and the step of enveloping the first polymer thus obtained with a second polymer, wherein the first polymer is a hydrophobic, water-insoluble polymer that can be converted into a hydrophilic, water-soluble polymer at an elevated pH value and/or at elevated ambient temperature, and the second polymer is a hydrophilic, water-soluble polymer.

15. (Third aspect of the invention) A method for producing a security element for securing value documents according to any of paragraphs 1 to 10, comprising the step of making available a layer, in particular a foil, based on a second polymer;

the step of applying a solution containing a feature substance and a first polymer onto the layer based on a second polymer; and the step of placing a further layer, in particular a foil, based on a second polymer onto the layer based on a second polymer that is equipped with the solution of the feature substance and the first polymer, wherein the first polymer is a hydrophobic, water-insoluble polymer that can be converted into a hydrophilic, water-soluble polymer at an elevated pH value and/or at elevated ambient temperature, and the second polymer is a hydrophilic, water-soluble polymer.

16. (Preferred embodiment) The method according to paragraph 15, wherein the step of applying a solution containing a feature substance and a first polymer onto the layer based on a second polymer is effected by printing a solvent-based lacquer containing the feature substance and the first polymer, and the step of placing a further layer based on a second polymer is effected after the drying of the printed lacquer.

17. (Preferred embodiment) The method according to paragraph 15 or 16, comprising the additional step of cutting the obtained layer structure into individual security elements.

18. (Fourth aspect of the invention) A value document, in particular a banknote, comprising a security element according to any of paragraphs 1 to 13.

19. (Preferred embodiment) The value document according to paragraph 18, wherein the feature substance is an IR absorber or a UV-excitable luminescent substance and the intensity of the IR absorption of the IR absorber and/or the intensity of the emission of the UV-excitable luminescent substance after the exposure of the value document in a medium having a pH value greater than 12, preferably greater than 10, and an ambient temperature greater than 90° C., preferably greater than 60° C., during a treatment duration of less than 60 minutes, preferably less than 30 minutes, is reduced by more than 50%, preferably by more than 90%.

Value documents in the context of the invention are objects such as banknotes, checks, shares, tokens, identity cards, passports, deeds and other documents, as well as labels. The value document substrate does not necessarily have to be a paper substrate; it could in particular be a plastic substrate or a substrate that has both paper constituents and plastic constituents.

The present invention permits making available security elements, for example mottling fibers or planchets, having feature properties such as UV luminescence, IR absorption or photochromism, which can be introduced into the paper during the paper production or can be applied to the paper and have sufficient stability to water and moisture, in order not to be destroyed during the paper production. At the same time, the security elements according to the invention are so unstable that they are destroyed under the more drastic conditions of the paper recycling process, i.e. at elevated temperature and at an elevated pH value. For the paper producer, therefore, high cost savings are possible; in addition, the present invention is particularly advantageous with regard to the ecological point of view. With the aid of the security elements according to the invention, for example faulty security paper sheets, value documents having production defects or worn value documents can be subjected to a conventional paper recycling process without difficulty, since the security elements are completely destroyed in the recycling process. This is achieved in particular by a suitable combination of water-soluble polymers, for example polyvinyl alcohol (PVA), and water-insoluble, hydrolysis-unstable polymers, for example polyvinyl acetate (PVAc). It is preferred that the water-insoluble polymer is converted into the water-soluble polymer by saponification in a basic medium, so that only one polymer type is present. The water-soluble polymer is preferably polyvinyl alcohol. Polyvinyl alcohol is frequently a constituent of the paper stock of value documents in larger quantities, since it is used, for example, in adhesive bonding and therefore does not adversely affect the properties of the paper stock obtained during recycling.

The security element is based in particular on a first polymer containing feature substances, which is completely or partially surrounded by a water-soluble second polymer. The water-soluble second polymer ensures the compatibility of the security element with the paper, since it is partially dissolved when coming into contact with the moist paper stock or the paper web and supports the fixed incorporation of the security element into the paper stock.

The second polymer is preferably polyvinyl alcohol or copolymers thereof, such as, for example, polyvinyl-pyrrolidone polyvinyl-alcohol copolymers or polyvinyl-alcohol polyethylene-glycol graft copolymers. Although polyvinyl alcohol has the best properties for incorporation into the paper stock, other water-soluble polymers, such as, for example, polyvinyl pyrrolidone, are likewise suitable.

The first polymer containing the feature substances is expediently sufficiently moisture-stable in order to withstand the incorporation into the paper stock without damage.

According to a preferred embodiment, the first polymer is a hydrophobic, water-insoluble polymer, for example polyvinyl acetate or certain polyesters. However, the hydrophobic polymer is characterized in that it can be converted into a hydrophilic polymer by an increased pH value and/or an elevated ambient temperature, for example by saponification of ester groups. For example, polyvinyl acetate can be saponified step by step to polyvinyl alcohol, which is then water-soluble. Furthermore, certain polyesters and other polymers can be split by saponification or other reactions into smaller, low-molecular units, as a result of which the polymer is destroyed.

According to a preferred embodiment, the first, water-insoluble polymer is converted in the recycling process in such a manner that it corresponds to the second (water-soluble) polymer type.

The combination of polyvinyl alcohol (PVA) and polyvinyl acetate (PVAc) is particularly preferred, since PVAc can easily be hydrolyzed to form PVA and thus, in addition to the safe PVA, no further polymers or polymer degradation products appear in the recycling process.

Security elements according to the invention can be formed in different ways. For example, the feature substance can be introduced into the first polymer by extrusion and subsequently enveloped with the second polymer. Alternatively, a solution containing the first polymer and the feature substance can be applied to the second polymer and subsequently covered by a further layer of the second polymer. The complete enveloping of the first polymer by the second polymer is advantageous, since otherwise no sufficient and homogeneous incorporation into the paper substrate can be effected. For example, when security elements not covered on both sides are added into the paper stock, no good incorporation is effected when the randomly distributed security elements touch the paper with their hydrophobic side. In the case of a complete envelope, both sides of the security element are hydrophilic, and are always readily incorporated into the paper stock even when arranged randomly.

According to a preferred embodiment, the security element is produced by printing or coating a PVA foil with a solvent-based printing lacquer that contains PVAc and the feature substance. The printed foil is preferably laminated with a second PVA foil after the drying of the printing lacquer, so that no free PVAc surfaces exist. This facilitates the introduction of the later security element, since untreated PVAc, in contrast to PVA, has no good compatibility with the paper stock and will thus be poorly incorporated. The security elements can then be obtained, for example, by cutting or punching out the laminated foils.

The PVAc surface of the singled security elements is preferably covered with PVA by more than 80%, particularly preferably more than 90%.

BRIEF DESCRIPTION OF THE DRAWINGS

There are shown.

DETAILED DESCRIPTION OF VARIOUS EMBODIMENTS

Figure 1:
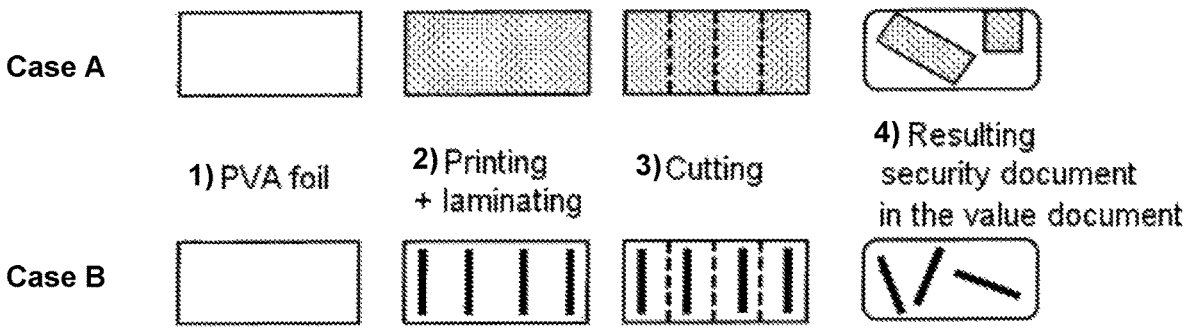
FIG. 1: two examples of the production of security elements according to the invention.

FIG. 1, case A, shows an example of the production of security elements according to the invention. According to this preferred embodiment, the PVA foil is printed all over, i.e. for the production of, for example, mottling fibers, the foil can be cut into strips, wherein mottling fibers having the same dimensions of the strips are obtained.

Particularly thin mottling fibers or other patterns that can be obtained only with difficulty by cutting or punching, however, cannot easily be produced in this manner. In this case, the following embodiment (see FIG. 1, case B) is more advantageous:

FIG. 1, case B, shows a further example of the production of security elements according to the invention. According to this preferred embodiment, the PVA foil is printed with a pattern that corresponds to the shape of the later security element. For example, a pattern of thin stripes can be printed, which represent the mottling fibers at the end, or other motifs, such as for example waves, circles or triangles. These can be cut out without difficulty when their distance from one another is chosen correspondingly. Since the PVA is largely dissolved when it is introduced into the paper stock, only the PVAc motif defined by the printing process remains as the visible security element.

According to a preferred embodiment, an edge is left free in two directions when printing the pattern (corresponds to FIG. 1, case B). This offers advantages, for example, when multi-colored patterns or complex shapes have to be cut out, since the cutting position can then be ensured relative to the pattern.

Figure 2:
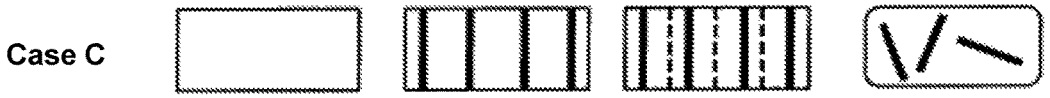
FIG. 2: a further example of the production of security elements according to the invention.

FIG. 2, case C, shows a further example of the production of security elements according to the invention. According to this preferred embodiment, an edge is left free only in one direction when printing the pattern. This offers advantages, for example, such as less material consumption when the printed pattern is configured in such a way that it can be cut through.

Figure 3:
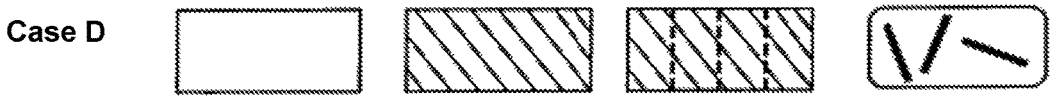
FIG. 3: a further example of the production of security elements according to the invention.

FIG. 3, case D, shows a further example of the production of security elements according to the invention. According to this preferred embodiment, lines or other patterns are printed with an oblique angle relative to the cutting direction. In this way, it is achieved that the pattern does not have to be aligned, or, in other words, the pattern position does not have to be adapted to the cutting position. For example, when cutting a foil with an obliquely printed line pattern into a plurality of strips of the same width, the same length distribution of lines always arises, even when the foil is inserted into the cutting tool in a slightly offset manner. An example of an obliquely printed line pattern is represented as case D in FIG. 3.

According to a further preferred embodiment, a pattern spacing that is unsynchronized relative to the cutting width is chosen; for example, the distance between two printed lines amounts to 1.01 times the cutting width. In this manner, for example, controlled distributions of random pattern distributions can be generated, or it can be prevented, for example, that all printed lines are cut exactly in the middle through a disadvantageous positioning of the cutting tool, as could be the case when the pattern spacing and the cutting width are identical.

Typical conditions in paper recycling are elevated temperatures, such as more than 60° C. for example, preferably more than 90° C., and an increased pH value, for example a pH greater than 8, preferably a pH greater than 10, particularly preferably a pH greater than 12, with great shear forces applied at the same time. Typical treatment durations are, for example, a treatment duration of more than 30 minutes, preferably more than 1 h. Special embodiments are advantageous to guarantee a complete destruction of the security element under these conditions. The term "complete destruction" is considered to mean that, when the paper stock is used again, no larger constituents of the security element remain that are visible to the eye, but a homogeneous impression of the paper stock is achieved. In particular, this does not mean that the feature substance decomposes.

When, for example, a mottling fiber dyed red and containing iron oxide is used as a magnetic security element, the term "complete destruction" means here that the polymer containing iron oxide has substantially completely dissolved and no mottling fiber fragments or the like can be recognized any more. The iron oxide particles continue to be present and are distributed homogeneously in the paper stock. However, since usually only very small quantities of security elements are present relative to the paper stock, these are no longer perceived when they are distributed homogeneously. Only in places where the feature substance is present in higher concentration, as in the polymer of the original security element, an increased perceptibility is given, which is thus disturbing after the recycling.

In certain cases, it can nevertheless be advantageous to use feature substances which weaken with respect to their perceptibility or which decompose during the recycling process. In this way, it is ensured that the recycled paper cannot or can hardly be distinguished from "fresh" paper, for example also in a forensic analysis with the aid of a microscope or other auxiliary means.

According to a preferred embodiment, the intensity of the feature substance used (for example the intensity of the emission of a UV-excitable luminescent substance or the intensity of the IR absorption of an IR absorber) is reduced during the treatment during the paper recycling by more than 50%, preferably by more than 90%.

It is pointed out that in conventional non-recyclable security elements the feature substance is protected by the surrounding substrate and is thus not attacked in the recycling process even if the feature substance should actually be unstable under the process conditions. It is therefore inherently necessary to employ dissolving security elements in order to achieve the desired effect.

According to a particularly preferred embodiment, the feature substance used is a core-shell particle. The core-shell particle is preferably based on two different polymers. Further preferably, the polymer of the shell can be attacked by the action of bases. The type and thickness of the shell are preferably chosen in such a manner that the feature substance, on the one hand, meets the necessary criteria for base stability that are necessary for use in value documents and, on the other hand, is largely destroyed under the harder conditions of the paper recycling. The shell is preferably a layer of melamine-formaldehyde condensation polymer. Although melamine-formaldehyde condensation polymers are normally chemically very resistant, the stability of the shell can be controlled very well over the thickness thereof, so that in this case a controlled adjustment of the instability with respect to hot aqueous bases is possible.

In order to ensure complete hydrolysis of the security feature, certain framework conditions are additionally necessary. In particular when water-insoluble polymers are employed, which have to be decomposed or converted first, it is not possible to use quantities as large as desired, since the hydrolysis otherwise consumes excessive time and is not completed within the usual paper recycling step.

According to a preferred embodiment case, less than 10 percent by weight of the security element is based on the water-insoluble polymer, particularly preferably less than 1 percent by weight.

In a further preferred embodiment case, the weight ratio of the used feature substance (e.g. the luminescent pigment used) in relation to the water-insoluble polymer that surrounds the feature substance is in particular at least 99:1, preferably at least 9:1, particularly preferably at least 1:1.

Furthermore, the chain length of the first polymer used that surrounds the feature substance has an influence on its hydrolysis rate, but also on the processability of the laminated foil composite.

In a preferred embodiment, the first polymer therefore has in particular a molecular weight of less than 100,000 g/mol. The hydrolysis rate is particularly high in this case.

In a further preferred embodiment, the first polymer has a molecular weight of more than 500,000 g/mol. The processability is particularly good in this case.

In a further preferred embodiment, the first polymer has a molecular weight in a range of 100,000 g/mol to 500,000 g/mol. A sufficient hydrolysis rate and good processability are combined in this case. For most application cases, this third embodiment is technically advantageous and is therefore particularly preferred compared to the other two embodiments.

In a preferred embodiment, the PVA foil has a thickness in the range of 10 to 100 μm, particularly preferably in a range of 15 to 60 μm.

In a preferred embodiment, the PVA foil is so-called hot-water-soluble PVA, which is a PVA that, in contrast to the so-called cold-water-soluble PVA, is dissolved completely only at elevated temperature, e.g. above 60° C. As a result, it is possible to adjust the security elements in such a manner that they can be introduced into the paper web by direct addition to the water of the paper machine, and the PVA completely dissolves only in the later drying process by heating the paper web.

In a preferred embodiment, the security elements are introduced into the water of the paper machine.

In a further preferred embodiment, the security elements are scattered onto the moist paper web, for example by employing a shaking channel.

In a preferred embodiment, a mixture is employed for coating or printing the PVA foil, said mixture being based on the feature substance and a solution of polyvinyl acetate in an organic solvent. The organic solvent is preferably ethyl acetate or acetone. Further constituents or solvents can be present, in order to improve the printing properties of the printing lacquer, for example the viscosity and wettability.

In a preferred embodiment, the recyclable security elements described here are combined with other, non-recyclable security elements or configured in such a manner that they are only partially recyclable. For example, in the value document green mottling fibers according to the invention can be mixed with red mottling fibers not forming part of the invention. Alternatively, in the production of the security elements, first (e.g. green) lines based on a hydrolysable polymer can be printed and second (e.g. red) lines based on a hydrolysis-stable printing lacquer can be printed. In this manner, it is also possible to construct parts of a security element from hydrolysable or hydrolysis-stable constituents. For example, in the case of a printed flag having three national colors, two national colors can be configured to be hydrolysable and one national color can be configured to be hydrolysis-stable.

When a paper or value document with a corresponding mixture of recyclable and non-recyclable security elements is recycled, thus, the non-recyclable security elements remain in the paper stock, or the security elements partially lose color or are discolored. In this manner, it can be tracked, for example, whether the paper stock is recycled material. This is advantageous in order to recognize, for example, counterfeits based on stolen paper factory rejects or based on recycled paper stock from shredded banknotes.

The invention will be described hereinafter with reference to preferred embodiment examples.

Embodiment Example 1: Blue Luminescent Mottling Fibers

A PVA foil having a thickness of 25 μm is coated with a solution of 1 percent by weight of polyvinyl acetate having a molar mass of 140,000 g/mol, which contains 10 percent by weight of a UV-excitable, blue luminescent security pigment based on core-shell particles. Ethyl acetate is chosen as the solvent. The coating has a weight per unit area of 5 grams per square meter. After evaporation of the ethyl acetate, the applied layer is covered with a second PVA foil having a thickness of 25 μm and is laminated by passing through a hot metal roller. The laminated foil composite is subsequently cut into mottling fibers having a size of 5 mm×1 mm and introduced into the paper stock during the paper production.

A paper is obtained having mottling fibers recognizable as blue stripes under UV light.

The paper is subsequently recycled (at great shear forces; at 80° C.; at a pH value of 11; treatment duration: 1 hour). New paper is produced from the resulting paper stock. Under UV light, no mottling fibers or other conspicuous features are visible any more.

Comparative Example 1: Blue Luminescent Mottling Fibers

A polyamide fiber having the same security pigment as in the embodiment example 1 is produced. Polyamide fibers are widely used as mottling fibers for banknotes; their production is generally known. These are, however, non-recyclable fibers.

In the same manner as in the embodiment example 1, a paper is obtained with mottling fibers recognizable as blue stripes under UV light.

The paper is subsequently recycled (great shear forces; 80° C.; pH 11; 1 hour). A new paper is produced from the resulting paper stock.

Under UV light, whole mottling fibers and their fragments, i.e. damaged or bent mottling fibers, are visible in the paper.

Embodiment Example 2: Green Luminescent Mottling Fibers

A PVA foil having a thickness of 30 μm is printed with a pattern of 5 mm long and 200 nm thick stripes. The printing ink employed is a mixture of acetone and 2 percent by weight of polyvinyl acetate having a molar mass of 200,000 g/mol, which contains 5 percent by weight of a UV-excitable, green luminescent security pigment based on core-shell particles.

The print thickness is 5 grams per square meter. After drying the print sample, it is covered with a second PVA foil having a thickness of 30 μm and is laminated by passing through a hot metal roller. The laminated foil composite is subsequently cut into pieces, wherein each piece contains a stripe of the printed stripe pattern, and is introduced into the paper stock during the paper production.

A paper is obtained having mottling fibers recognizable as green stripes under UV light.

The paper is subsequently recycled (great shear forces; 80° C.; pH 11; 1 hour). A new paper is produced from the resulting paper stock. Under UV light, no mottling fibers or other conspicuous features are visible any more.

Embodiment Example 3: IR Absorber Planchets

A PVA foil having a thickness of 50 μm is coated with a solution of 1 percent by weight of polyvinyl acetate having a molar mass of 140,000 g/mol, which contains 10 percent by weight of an IR absorber pigment based on core-shell particles. The solvent used is ethyl acetate. The coating has a weight per unit area of 5 grams per square meter. After evaporation of the ethyl acetate, the applied layer is covered with a second PVA foil having a thickness of 50 μm and is laminated by passing through a hot metal roller. The laminated foil composite is subsequently cut into planchets having a size of 5 mm×5 mm and introduced into the paper stock during the paper production.

A paper is obtained which, when viewed with suitable devices, for example with an IR sensor for banknotes, exhibits corresponding places with IR absorption.

The paper is subsequently recycled (great shear forces; 80° C.; pH 11; 1 hour). A new paper is produced from the resulting paper stock. When viewed again, no places with IR absorption or other conspicuous features are visible any more.

Embodiment Example 4: Red Luminescent Shapes

A PVA foil having a thickness of 25 μm is printed with a solution of 1 percent by weight polyvinyl acetate having a molar mass of 140,000 g/mol, which contains 10 percent by weight of a UV-excitable, red luminescent security pigment based on core-shell particles. The solvent used is ethyl acetate. The printing pattern is based on a multiplicity of objects in the form of small fish having a size of approximately 2 mm×4 mm. The print thickness in this case has a weight per unit area of 5 grams per square meter After evaporation of the ethyl acetate, the print sample is covered with a second PVA foil having a thickness of 25 μm and is laminated by passing through a hot metal roller. The laminated foil composite is subsequently cut into pieces, wherein each piece contains one of the fish-like objects, and is introduced into the paper stock during the paper production.

A paper is obtained with objects recognizable as small red fish under UV light.

The paper is subsequently recycled (great shear forces; 80° C.; pH 11; 1 hour). A new paper is produced from the resulting paper stock. Under UV light, no luminescent objects or other conspicuous features are visible any more.

Embodiment Example 5: Partially Recyclable Planchets

A PVA foil having a thickness of 40 μm is printed with a three-colored pattern of UV luminescent inks, for example a national flag of the size 6 mm×4 mm, which contains the colors blue, white and red. The individual printed national flags each have a distance of 10 mm from each other on all sides, so that they can be separated from one another without difficulty by cutting the foil. The blue and white portions of the pattern are printed with a printing lacquer that consists of a combination of luminescent pigment, ethyl acetate and polyvinyl acetate, and are subsequently dried. The blue and white portions dissolve in the recycling process. The red portions of the pattern are printed with a UV-curing printing lacquer that contains the luminescent pigment, and are cured by UV irradiation. UV-curing printing lacquers are often used for printing value documents and generally exhibit a very high stability with respect to water and aqueous solutions. The red portions are stable to the recycling process and thus remain unchanged.

When such planchets are introduced into the paper stock during the paper production, a security paper is obtained that shows multi-colored national flags under UV light. The paper can additionally contain further (e.g. invisible or forensic) features or can have special properties, for example haptic properties or optical properties. When such a paper or residues of value documents produced therefrom are recycled, for example in order to produce forgeries, clearly visible red portions of the original multi-colored pattern remain in the recycled paper. The paper can thus be uniquely identified as recycled material of the original security paper, even if the other properties (other features, haptic and optical properties) correspond to those of the original security paper.

The invention claimed is:

1. A security element for securing value documents, comprising a first polymer containing a feature substance, which is at least partially surrounded by a second polymer, wherein the first polymer is a hydrophobic, water-insoluble polymer which, at an elevated pH value and at elevated ambient temperature at a treatment duration of less than 60 minutes can be converted into a hydrophilic, water-soluble polymer, and the second polymer is a hydrophilic, water-soluble polymer, wherein the elevated pH value is greater than 12 and the elevated ambient temperature is greater than 90° C.

2. The security element according to claim 1, wherein the security element, when introduced into a moist paper stock, results in a mottling fiber or planchet.

3. The security element according to claim 1, wherein the feature substance has luminescent, magnetic or photochromic properties.

4. The security element according to claim 1, wherein the first polymer can be converted into a water-soluble polymer by saponification in a basic medium.

5. The security element according to claim 4, wherein the first polymer is polyvinyl acetate or a polyester.

6. The security element according to 1, wherein the second polymer is polyvinyl alcohol or a polyvinyl alcohol copolymer.

7. The security element according to claim 1, wherein the feature substance is a core-shell particle.

8. The security element according to claim 1, wherein the proportion of the first, hydrophobic, water-insoluble polymer in the security element amounts to less than 10 wt.-%.

9. The security element according to claim 1, wherein the weight ratio of the feature substance in relation to the first, hydrophobic, water-insoluble polymer amounts to at least 1:1.

10. The security element according to claim 1, wherein the first, hydrophobic, water-insoluble polymer has a molecular weight in a range of 100,000 g/mol to 500,000 g/mol.

11. The security element according to claim 1, wherein the security element is obtainable by a method comprising the step of introducing a feature substance into a first polymer by means of extrusion; and the step of enveloping the first polymer thus obtained with a second polymer.

12. The security element according to claim 1, wherein the security element is obtainable by a method comprising the step of making available a layer based on a second polymer;

the step of applying a solution containing a feature substance and a first polymer onto the layer based on a second polymer; and the step of placing a further layer based on a second polymer onto the layer based on a second polymer that is equipped with the solution of the feature substance and the first polymer.

13. The security element according to claim 12, wherein the layers each have foils having a thickness in the range of 10 to 100 micrometers.

14. A method for producing a security element for securing value documents according to claim 1, comprising the step of introducing a feature substance into a first polymer by means of extrusion; and the step of enveloping the first polymer thus obtained with a second polymer, wherein the first polymer is a hydrophobic, water-insoluble polymer that can be converted into a hydrophilic, water-soluble polymer at an elevated pH value and/or at elevated ambient temperature, and the second polymer is a hydrophilic, water-soluble polymer.

15. A method for producing a security element for securing value documents according to claim 1, comprising the step of making available a layer based on a second polymer;

the step of applying a solution containing a feature substance and a first polymer onto the layer based on a second polymer; and the step of placing a further layer based on a second polymer onto the layer based on a second polymer that is equipped with the solution of the feature substance and the first polymer, wherein the first polymer is a hydrophobic, water-insoluble polymer that can be converted into a hydrophilic, water-soluble polymer at an elevated pH value and/or at elevated ambient temperature, and the second polymer is a hydrophilic, water-soluble polymer.

16. The method according to claim 15, wherein the step of applying a solution containing a feature substance and a first polymer onto the layer based on a second polymer is effected by printing a solvent-based lacquer containing the feature substance and the first polymer, and the step of placing a further layer based on a second polymer is effected after the drying of the printed lacquer.

17. The method according to claim 15, comprising the additional step of cutting the obtained layer structure into individual security elements.

18. A value document comprising a security element according to claim 1.

19. The value document according to claim 18, wherein the feature substance is an IR absorber or a UV-excitable luminescent substance and the intensity of the IR absorption of the IR absorber and/or the intensity of the emission of the UV-excitable luminescent substance after the exposure of the value document in a medium having a pH value greater than 12 and an ambient temperature greater than 90° C. during a treatment duration of less than 60 minutes is reduced by more than 50%.

* * * * *